United States Patent [19]

Leccese

[11] 4,148,269

[45] Apr. 10, 1979

[54] METHOD OF MAKING DRIPLESS METAL CAN NOZZLE

[75] Inventor: Vincent L. Leccese, Homerville, Ga.

[73] Assignee: Standard Container Company, Montclair, N.J.

[21] Appl. No.: 798,445

[22] Filed: May 19, 1977

Related U.S. Application Data

[62] Division of Ser. No. 661,650, Feb. 26, 1976, abandoned.

[51] Int. Cl.[2] ..... B21D 22/00

[52] U.S. Cl. ..... 113/116 DD; 72/359; 113/120 M

[58] Field of Search ..... 113/116 DD, 120 M, 120 V, 113/120 AA; 72/352, 354, 359, 370

[56] References Cited

U.S. PATENT DOCUMENTS

| | | | |
|---|---|---|---|
| 1,673,645 | 6/1928 | Smith et al. | 113/120 V X |
| 2,218,102 | 10/1940 | Van Blarcom | 72/354 |
| 2,851,980 | 9/1958 | Kraicinski | 72/427 X |
| 3,225,581 | 12/1965 | Hinderer | 72/370 |

*Primary Examiner*—Leon Gilden

*Attorney, Agent, or Firm*—Brumbaugh, Graves, Donohue & Raymond

[57] ABSTRACT

A method of making a dripless tubular metal can nozzle forms a hem at the rim of the nozzle by doubling-over the metal at the top end of the tube so the terminal edge of the tube lies on top of the hem and radially inwardly from the outward extremity of the rim. The sharp bend formed by doubling-over the metal to make the hem is the outward extremity of the rim, and is effective to prevent formation of drips.

16 Claims, 4 Drawing Figures

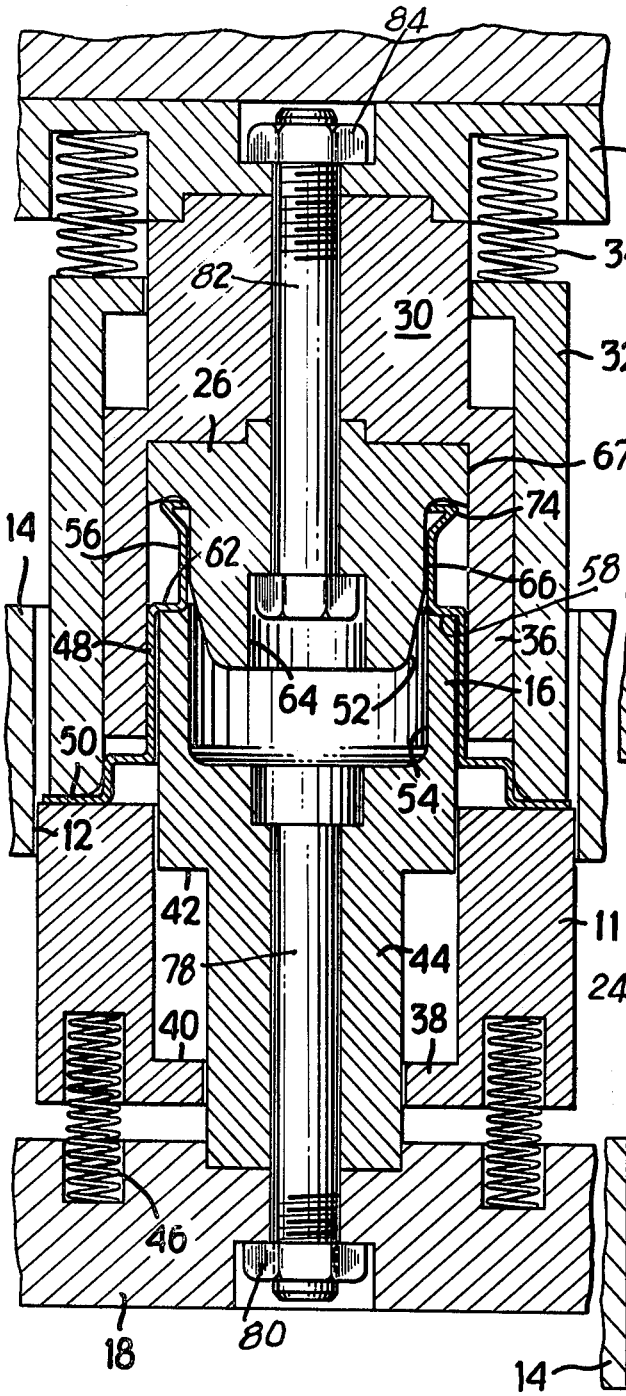
FIG. 3
FIG. 4
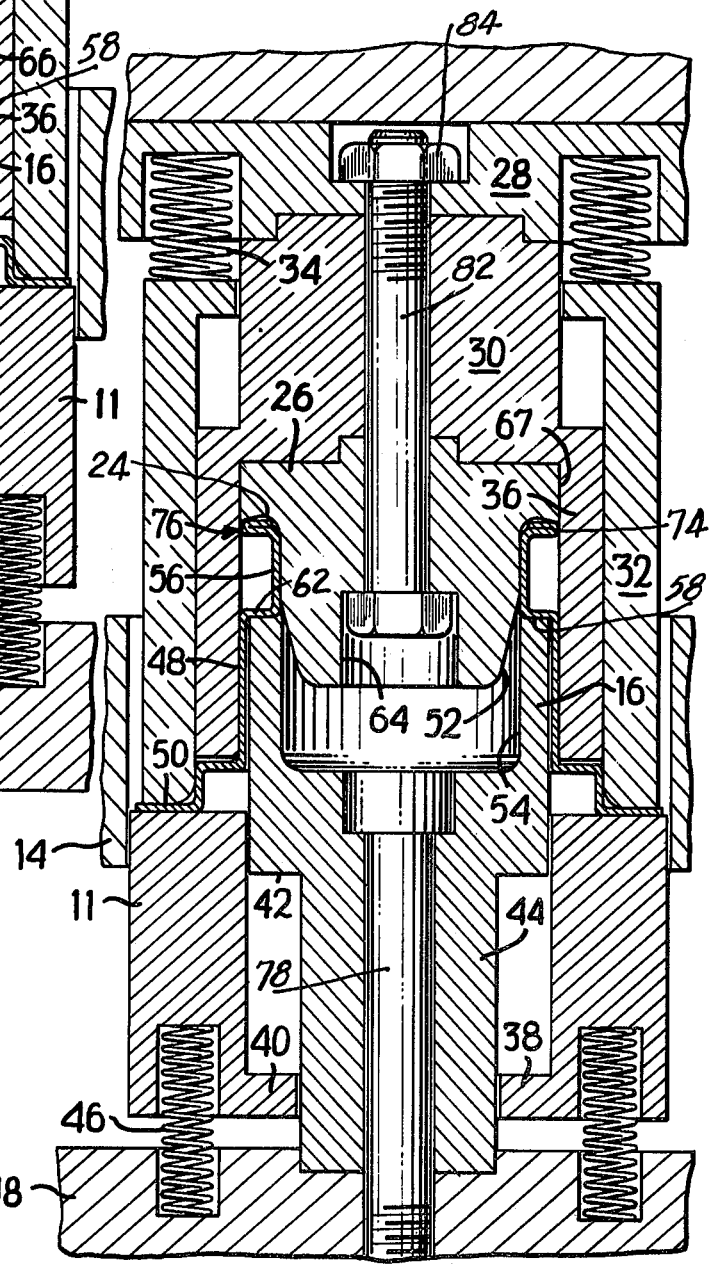

METHOD OF MAKING DRIPLESS METAL CAN NOZZLE

This is a division, of application Ser. No. 661,650 filed Feb. 26, 1976 now abandoned.

BACKGROUND OF THE INVENTION

This invention relates to a method of making dripless metal can nozzles and more particularly to a method of making dripless can nozzles which can be fashioned from low cost tin plate.

In metal containers, and particularly in containers for food stuffs and for hazardous materials such as fuel and poisonous substances, it is desirable to prevent drops from forming on the nozzle of the can after the can is uprighted from its pouring position. Drops that remain on the rim of the nozzle will tend to run down the outside of the nozzle and collect on the top of the can around the top rim of the can, resulting in unsanitary conditions for food cans and dangerous conditions for cans containing hazardous substances.

In non-metallic containers a dripless rim is formed by forming a sharp edge at the outward extremity of the rim to cut off the liquid flow sharply when the container is righted after pouring. In metal containers, and particularly in sheet metal containers, it is not feasible to form the terminal edge of the nozzle in a free edge because the metal is sharp and easily deformed at the rim. The sharp edge presents a danger of cuts to the user, and a deformed rim leaks because it is no longer perfectly coplanar with the cap and its seal.

Accordingly, the best dripless nozzle for a sheet metal can to date has been the use of an outward curl on the nozzle rim. The outward curl increases the strength of the rim so that it is able to resist dents and the like which would prevent a good seal with a cap. The curl is continued around so that the free end of the metal is tucked underneath the curl and therefore does not present the danger of a sharp metal edge to the user.

The curl nozzle rim is expedient because it is inexpensive and produces a rim which provides some dripless effect. However, there are several disadvantages to this type of nozzle which the art has long sought to eliminate. It is necessary to use a metal having high ductility, otherwise, when the outward curl is formed the terminal edge of the metal will split which can result in leaks. Moreover, although the dripless feature of this form of nozzle is better than other available sheet metal can nozzles, it would be desirable to improve this feature.

One approach to the prevention of splits in the rim of low ductility sheet metal can nozzles was to form an initial outward flare at the can top and then form an inside hem at the rim in preparation for forming the full bead or curl at the rim of the can nozzle. Although this technique did indeed prevent splits in the metal, it did not result in improved dripless performance.

Accordingly, the art has long looked in vain for a sheet metal can nozzle which could be formed of low cost, low ductility sheet metal and which would provide excellent dripless performance.

SUMMARY OF THE INVENTION

It is therefore an object of this invention to provide a can nozzle having a strong, dripless rim free of splits and which can be formed of low cost, low ductility sheet metal.

The method of this invention makes a can nozzle from a tube whose rim is formed in a hem or flattened crimp. The terminal edge of the tube lies flat atop the crimp and the 180° flattened bend in the crimp forms the top radial extremity.

DESCRIPTION OF THE DRAWINGS

These and other objects of the invention will become better understood by reference to the following detailed description of a preferred embodiment of the invention when read in conjunction with the following drawings, wherein:

FIG. 3 is an elevation of the nozzle blank seated on the die with the male forming member beginning to form a hem on the rim of the nozzle blank; and FIG. 4 is an elevation of the nozzle blank seated on the die with the male forming member in fully extended position wherein the hem of the dripless rim is formed.

DESCRIPTION OF THE PREFERRED EMBODIMENT

Figure 1:
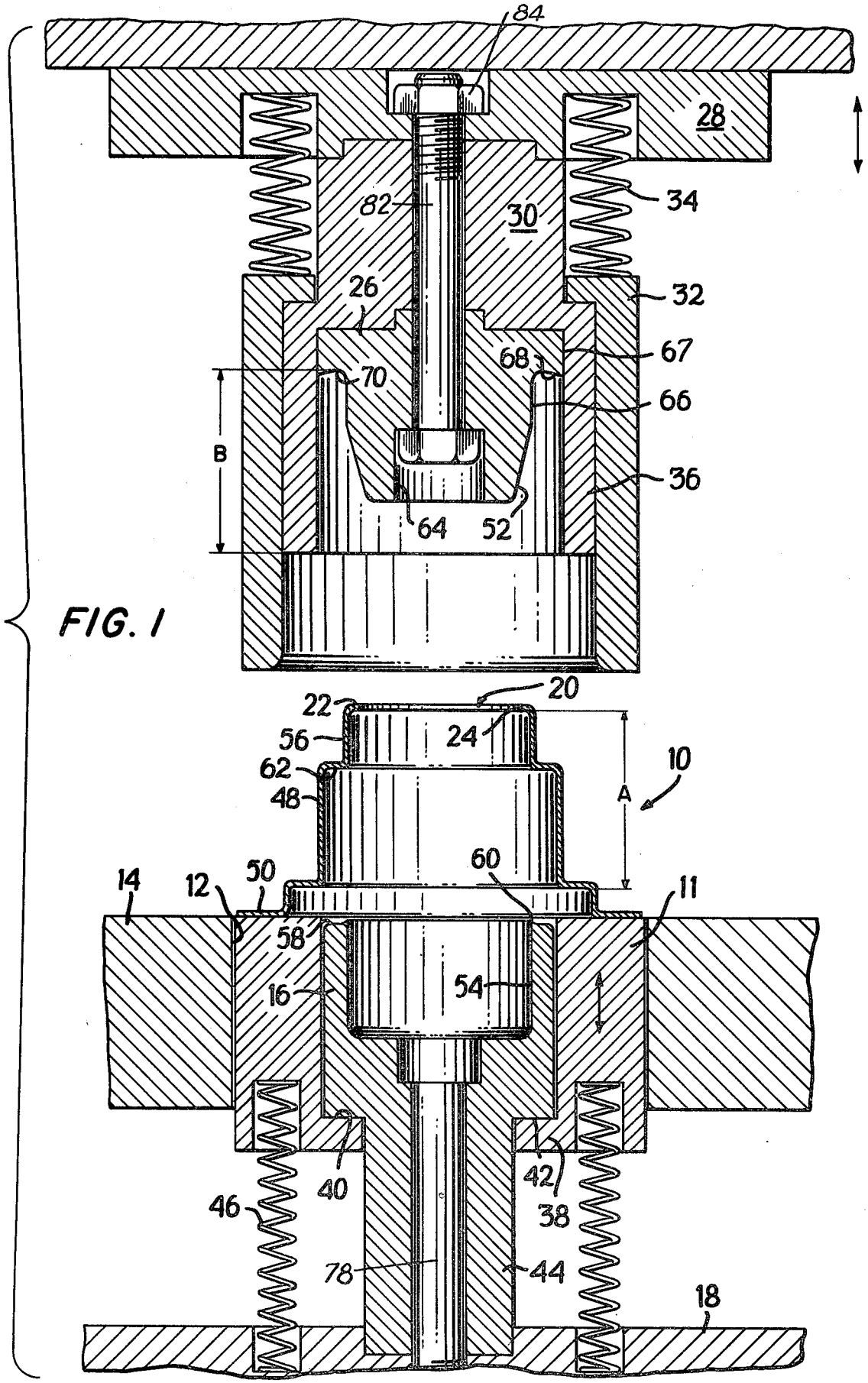
FIG. 1 is a cross-sectional elevation of a pierced nozzle blank seated on the pressure ring of a transfer press feed table in alignment over a stationary die and under a vertically movable male forming member poised to enter the pierced opening.

Referring now to the drawings wherein like reference characters identify similar or identical parts, and more particularly to FIG. 1 thereof, a nozzle blank 10 is shown resting on the top surface of a pressure ring 11 slidably disposed in an opening 12 of a transfer press feed table 14. The transfer press used in the practice of this invention is similar to a Bliss 102 Model 8183 transfer press made by E. W. Bliss Co. of Hastings, Michigan. This transfer press includes five stations at which successive operations are simultaneously carried out on a line of five nozzle blanks aligned with each station in the press. After each stroke of the press, the line of blanks is advanced by a suitable feeding device along the feed table 14 of the press a distance equal to the distance between the stations. In this way, each nozzle blank proceeds step by step through the press and at each station receives the forming or cutting step performed at that station, emerging finally after station V as a fully formed, rimmed and trimmed nozzle blank.

Operations I–III on this transfer press relate to the forming of the nozzle blank 10 as it is shown in FIG. 1. Operation V trims the bottom flange off the nozzle blank. The rim of the nozzle blank, which is the subject of this application, is formed at station IV.

In FIG. 1, the nozzle blank is shown in place above a die 16 mounted on a die holder 18 secured to the bed (not shown) of the transfer press. During the previous cycle, at station III on the press, a center end opening 20 had been punched out at the top end of the nozzle blank 10, leaving a short inwardly extending peripheral flange 22 at the top end of the nozzle blank, the terminal edge 24 of which defines the opening 20.

Aligned vertically above the die 16 is a male forming member 26 secured to a die holder 28 on the upper, vertically movable section or ram (not shown) of the press. The male forming member 26 is mounted within a support ring 30 mounted in turn on the upper die holder 28. A stripping ring 32 is slidably mounted on the support ring 30 and is biased downwardly by springs 34. The support ring 30 includes a depending skirt portion 36 which extends vertically alongside and spaced radially outward from the male forming member 26 and is coaxially aligned vertically above the die 16 and has an inside diameter slightly larger than the outside diameter of the die 16, for a purpose to be explained below.

The top surface of the pressure ring 11 is normally maintained coplanar with the top surface of the feed table 14 by an inwardly extending flange 38 which forms a shoulder 40 abutting a complementary shoulder 42 formed at the junction of the upper portion of the die 16 and a lower, narrower portion 44 thereof which is mounted on the die holder 18. The pressure ring 11 is biased upwardly into engagement with the shoulder 42 by springs 46 so that the upper surfaces of the feed table 14 and the pressure ring 11 present a smooth coplanar surface on which the nozzle blanks can be slid while the press ram is raised.

As the press cycle commences, the ram of the press descends vertically, carrying with it the upper die holder 28 on which are mounted the male forming member 26 and the support ring 30. The depending skirt 36 of the support ring 30 slides over the tubular body 48 of the nozzle blank to support it from collapse during the rim-forming operation. Also, the stripping ring 32 engages the bottom flange 50 of the nozzle blank and clamps it against the pressure ring 11. The lower end of the male forming member 26 is tapered at 52 and this tapered end enters the punched opening 20 in the nozzle blank 10. These actions will occur in different sequence depending on the dimensions and spring forces selected, but the effect is to push the nozzle blank 10 and the pressure ring 11 downward around the die 16 before the rim-forming operation has advanced significantly.

Figure 2:
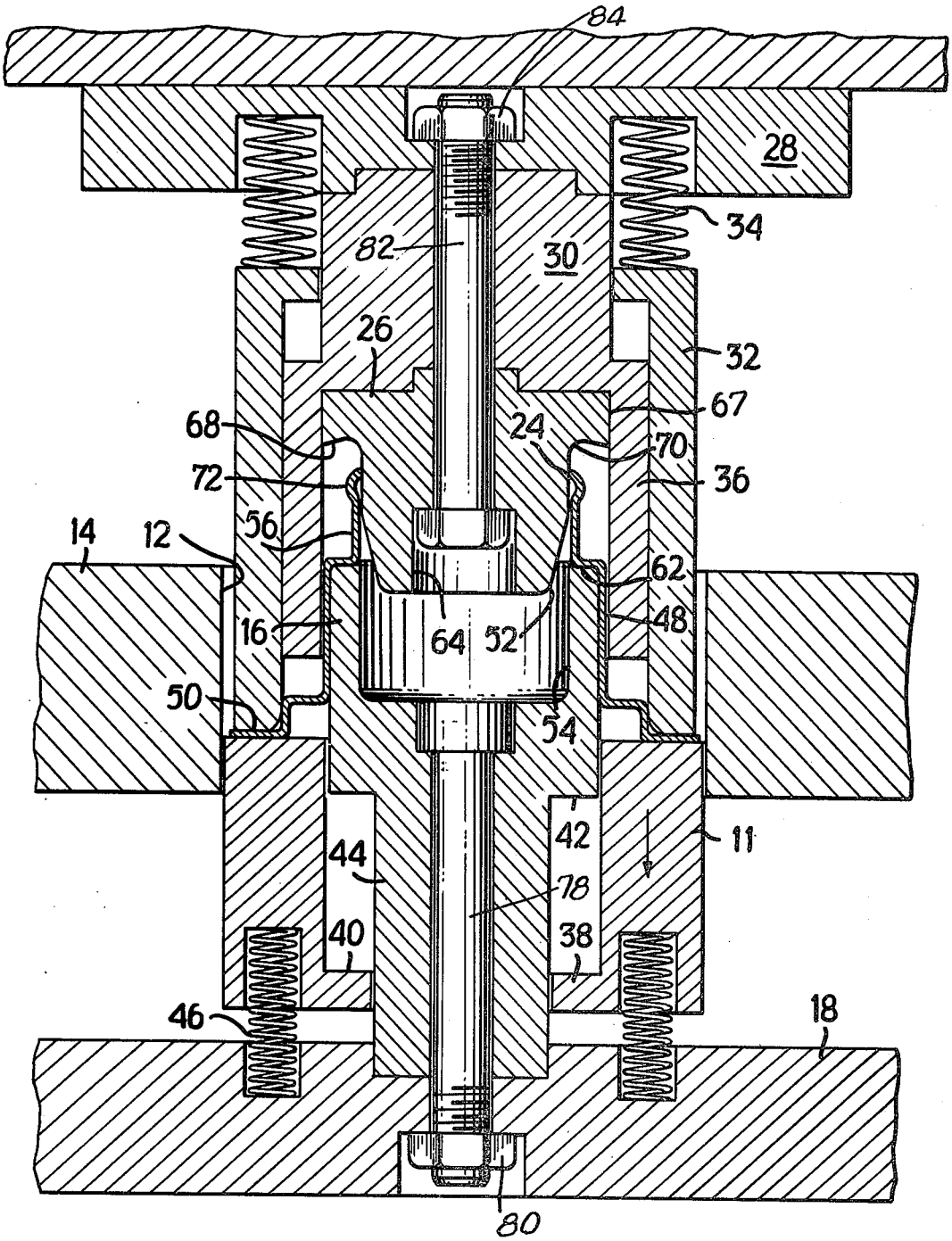
FIG. 2 is an elevation of the nozzle blank seated on the die and with the male forming member extending partially into the pierced opening.

The die 16 has a central, stepped bore 54 through which a bolt 78 extends for securing the die to die holder 18 using a nut 80 (see FIGS. 2 and 3). The upper end of the bore 54 is enlarged to slightly less than the diameter of a necked-in portion 56 of the upper end of the nozzle blank to provide a supporting shoulder 58 for supporting the nozzle blank 10 while receiving the lower, tapered end 52 of the forming member 26 during the forming operation. The top peripheral edge of the bore 54 is raised to form a raised rim 60. The necked-in portion 56 of the nozzle blank 10 provides an interior shoulder 62 which seats around the raised rim 60 of the die 16 while the nozzle blank 10 is supported on the supporting shoulder 58 of the die 16. This tends to center the nozzle blank 10 coaxially on the die 16 so that the central opening 20 will be properly aligned with the male forming member 26, and the raised rim 60 supports the radius at the junction of the necked-in portion 56 and the shoulder 62.

The male forming member 26, like the die 16, has a central, stepped bore 64 formed therethrough by which it is secured to the upper die holder 28 of the press using a bolt 82 and a nut 84. The forming member 26, like the die 16, is generally cylindrical in shape and includes the lower tapering or conical end portion 52 which merges into an intermediate cylindrical portion 66. An upper cylindrical portion 67 of larger diameter than the intermediate cylindrical portion 66 forms therewith a shoulder 68 at the juncture of the two cylindrical portions 66 and 68. A smooth outward bend 70 of small radius, e.g., 1/32", is formed where the cylindrical portion 66 meets the shoulder 68, for a purpose to be described hereinafter.

After the nozzle blank 10 has moved down around and is centered and supported on the die 16, the conical end portion 52 of the male forming member 26 spreads the inwardly extending peripheral flange 22 upwardly and outwardly as shown in FIG. 2. The flange 22 does not however assume a perfectly cylindrical shape but rather becomes part of a slightly outwardly bulged nozzle blank terminus 72 as shown in FIG. 2.

As the male forming member 26 continues its descent into central opening 20 in the nozzle blank 10 the terminal edge 24 contacts the bend 70 and the outward bulge of the terminus 72 predisposes the terminus 72 to fold outwardly at its midsection 74, as shown in FIG. 3, rather than to follow the curve of the bend 70 around to the outside which would produce the conventional outward curl in the nozzle rim. This outward folding of the terminus 72 at 74 begins the formation of a hem 76 (see FIG. 4) at the rim of the nozzle blank 10. It is believed that the outward folding at 74 of the terminus 72 is caused by the small radius of curvature of the bend 70, and also the predisposing initial outward bulge of the terminus 72.

The male forming member 26 continues its descent to complete the formation of the hem 76, as shown in FIG. 4, by flattening the portion of the terminus 72 above the fold at 74 down over the portion of the terminus 72 immediately below the fold at 74. In the hem 76, or flattened crimp thus formed, the fold at 74 is fully bent over 180° and thus becomes the outward radial extremity of the rim. The terminal edge 24 of the nozzle blank lies atop and flat against the top surface of the hem 76. While the hem 76 was being formed by bending and flattening the terminus 72 over double, as shown in FIGS. 3 and 4, the cylindrical portion 66 of the male forming member 26 supported the necked-down cylindrical portion 56 of the nozzle blank 10 from the inside to prevent crushing or other deformation of the nozzle blank 10. The nozzle blank 10 is also supported vertically by engagement of the shoulder portion 62 on the top shoulder 58 of the die 12, and the tubular wall 48 is supported on the inside by the exterior wall of the die 16 and on the outside by the interior wall of the depending skirt 36 of the support ring 30.

After the rim hem 76 is formed, the ram ascends carrying the forming member 26 and the support ring 30. The pressure ring 11 rises to its normal height, forcing the nozzle blank 10 off the die 16, and the stripping ring 32 is pushed down by springs 34, forcing the nozzle blank 10 off the forming member 26. The nozzle blank 10 is left sitting atop the pressure ring 11 ready to be transferred to the next station.

The nozzle rim hem 76 provides a doubled-over section of metal at the rim of the nozzle to provide strength to resist dents and the like and, because of the sharp bend at the outer radial extremity of the rim, cuts the stream of liquid sharply when the can is righted to prevent droplets from forming on the rim and running down the outside surface of the nozzle. The radius of the bend is much sharper than the corresponding radii of the radial extremities of the nozzle rims heretofore achieved in the prior art configurations despite the fact that this nozzle may be formed of low ductility sheet metal. It is thought that splits do not occur in the terminal edge 24 of the metal because, instead of bending the terminal edge 24 outward as in the conventional curling operation which subjects the terminal edge 24 to a degree of stress which is high enough to cause splits in low ductility sheet metal, the terminal edge 24 is bent inwardly to lie flat against the top surface of the hem.

The foregoing description of the manner of carrying out my invention is meant to be illustrative only. In view of this teaching, it should now be clear to those skilled in the art how to carry out the method defined in the appended claims which is not to be limited by the particular manner and means of fabrication disclosed herein.

I claim:

1. A method of forming a can nozzle from a metal nozzle blank having at its top end an inwardly turned flange with an inner edge, which defines an opening in the top end of the nozzle blank, comprising the steps of:
   (a) spreading the flange upwardly and outwardly to widen the opening and form an outward bulge in the top end of the nozzle blank;
   (b) folding the bulge outwardly and sharply at substantially its midsection; and
   (c) flattening the portion of the bulge above the fold down over the portion of the bulge below the fold until adjacent surfaces of the two portions of the bulge lie flat against each other to form a flat outwardly extending hem at the top end of the nozzle blank.

2. The method defined in claim 1, further comprising the step of supporting the nozzle blank on a die during said spreading, folding and flattening steps.

3. The method defined in claim 2, further comprising the step of stripping the die from the nozzle blank after said spreading, folding and flattening steps.

4. The method defined in claim 1, wherein said spreading, folding and flattening steps are performed by pressing a single forming member into the opening in the top end of the nozzle blank.

5. The method defined in claim 4, further comprising the step of stripping the forming member from the nozzle blank after said spreading, folding and flattening steps.

6. The method defined in claim 1, further comprising the step of supporting the nozzle blank radially from within against radial and axial collapse of a generally vertical sidewall thereof below the bulge.

7. The method defined in claim 6, wherein the hem is substantially perpendicular to the sidewall of the nozzle blank.

8. The method defined in claim 6, wherein said folding and flattening steps are performed simultaneously with said supporting step by pressing radially outwardly and downwardly on the inner edge of the top end of the nozzle blank.

9. The method defined in claim 8, wherein said supporting, spreading, folding and flattening steps are performed by pressing a single forming member into the opening in the top end of the nozzle blank.

10. The method defined in claim 9, wherein said spreading step is performed by a tapered portion of the forming member.

11. The method defined in claim 9, wherein said folding and flattening steps are performed by an outwardly extending and downwardly facing bend and shoulder on the forming member.

12. The method defined in claim 11, wherein said bend has a radius of about 1/32".

13. A method of forming a can nozzle from a metal nozzle blank having at its top end an inwardly turned annular flange with an inner circumferential edge, which defines an opening in the top end of the nozzle blank, and a shoulder between an upper portion of the nozzle blank and a larger diameter lower portion, comprising the steps of:
   (a) supporting the shoulder of the nozzle blank from below and within by seating the nozzle blank on a die having approximately the same cross-sectional shape and size as the inside circumferential shape and size of the lower portion of the nozzle blank;
   (b) spreading the flange upwardly and outwardly to widen said opening and form an outward bulge in the top end of the nozzle blank;
   (c) folding the bulge outwardly and sharply at substantially its midsection; and
   (d) flattening the portion of the bulge above the fold down over the portion of the bulge below the fold until adjacent surfaces of the two portions of the bulge lie flat against each other to form a flat outwardly extending hem at the top end of the nozzle blank.

14. The method defined in claim 13, wherein said spreading, folding and flattening steps are performed by a single stroke of a unitary forming member.

15. The method defined in claim 14, further comprising the step of stripping the nozzle blank from the forming member and the die after said spreading, folding and flattening steps.

16. A method of forming a can nozzle from a metal nozzle blank having an upper portion terminating in an inwardly extending annular flange with an inner circumferential edge, which defines an opening in the top end of the nozzle blank, a lower portion of greater diameter than the upper portion and a shoulder at the junction of the upper and lower portions of the nozzle blank, comprising the steps of:
   (a) positioning the nozzle blank on a pressure ring in approximate axial alignment over a coaxial die;
   (b) pressing down on the nozzle blank and the pressure ring to cause the pressure ring and the nozzle blank to descent relative to the die until the shoulder of the nozzle blank is seated on the die;
   (c) spreading the flange upwardly and outwardly to widen the opening and form an outward bulge in the top end of the nozzle blank;
   (d) folding the bulge outwardly and sharply at substantially its midsection; and
   (e) flattening the portion of the bulge above the fold down over the portion of the bulge below the fold until adjacent surfaces of the two portions of the bulge lie flat against each other to form a flat outwardly extending hem at the top end of the nozzle blank.

* * * * *